United States Patent [19]

Otaka

[11] Patent Number: 4,630,205

[45] Date of Patent: Dec. 16, 1986

[54] SYSTEM FOR AUTOMATICALLY CONTROLLING NAVIGATION

[75] Inventor: Hideo Otaka, Tochigi, Japan

[73] Assignee: Kabushiki Kaisha Komatsu Seisakusho, Tokyo, Japan

[21] Appl. No.: 608,714

[22] Filed: May 10, 1984

[51] Int. Cl.[4] ..... G06F 15/50

[52] U.S. Cl. ..... 364/424; 440/1; 441/80

[58] Field of Search ..... 364/424, 569; 340/52 R, 340/52 F; 440/1; 441/80

[56] References Cited

U.S. PATENT DOCUMENTS

| | | | |
|---|---|---|---|
| 3,026,545 | 3/1962 | Brainard | 441/80 X |
| 3,807,343 | 4/1974 | Peebles | 440/1 |
| 3,826,218 | 7/1974 | Hiersig et al. | 440/1 |
| 4,022,146 | 5/1977 | Sadler | 440/1 |
| 4,228,556 | 10/1980 | Searls | 441/80 X |
| 4,305,143 | 12/1981 | Simms et al. | 441/80 X |

*Primary Examiner*—Gary Chin

*Attorney, Agent, or Firm*—Frost & Jacobs

[57] ABSTRACT

A system for automatically controlling navigation of a ship, particularly a small-sized ship in which the sole crew is on board, has a radio transmitter attached to the body of the crew, a radio receiver installed on board the ship so as to receive a signal transmitted by the radio transmitter, and a control command unit connected with the output side of the radio receiver so as to control the prime mover of the ship to thereby stop the ship when the crew fell overboard. The radio transmitter is adapted to transmit a radio signal while the crew is on board the ship and stop or attenuate the signal when the crew fell overboard, while the radio receiver is adapted to transmit an output signal to the control command unit when the generation of the signal by the transmitter is stopped or when the signal is attenuated.

4 Claims, 3 Drawing Figures

SYSTEM FOR AUTOMATICALLY CONTROLLING NAVIGATION

BACKGROUND OF THE INVENTION

This invention relates to a system for automatically controlling navigation of a ship, and more particularly to a system for automatically controlling navigation of a small-sized ship adapted to stop the ship automatically when the sole crew member falls overboard.

In general, the crew of a small-sized ship is only one person who maneuvers it. Therefore, if he fell overboard while working on board the ship under navigation, he meets with a disaster in most cases because the ship cannot be stopped.

SUMMARY OF THE INVENTION

The present invention has been contemplated in view of the aforementioned circumstances, and has for its object to provide a system for automatically controlling navigation of a ship adapted to control and stop the ship to enable the sole crew member who falls overboard to rescue himself.

Another object of the present invention is to provide a system for automatically controlling navigation of a ship arranged to automatically reduce the running speed of the ship when the sole crew member falls overboard and to move the ship ahead or astern at a low speed to a position in his vicinity.

To achieve the aforementioned objects, according to an aspect of the present invention, there is provided a system for automatically controlling navigation of a ship which comprises a radio transmitter adapted to be attached to the body of the sole crew member, a radio receiver installed on board the ship so as to receive a signal transmitted by said radio transmitter, and a control command unit connected with the output side of said radio receiver so as to control the prime mover of the ship to thereby stop the ship when the crew member falls overboard.

According to a further aspect of the present invention, there is provided a system for automatically controlling navigation of a ship, wherein said radio transmitter is adapted to transmit a radio signal while the sole crew member is on board the ship and stop or attenuate the signal when the crew member falls overboard, whilst said radio receiver is adapted to transmit an output signal to said control command unit when the generation of the signal by said transmitter is stopped or when the signal is attenuated.

According to a still further aspect of the present invention, there is provided a system for automatically controlling navigation of a ship, wherein said control command unit is adapted, when the sole crew member falls overboard, to receive an output signal from said radio receiver to thereby decelerate the ship, compute the time which passes away from the time when the crew member fell overboard to the time when the ship has been decelerated, and control the power line and the steering system of the ship in accordance with the computed time so that the ship may be moved ahead or astern at a low speed to a position near the crew member and then stopped.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

BRIEF DESCRIPTION OF THE INVENTION

FIG. 1 is a schematic drawing of one embodiment of the system for automatically controlling navigation of a ship according to the present invention, and FIGS. 2 and 3 are explanatory views of the system shown in FIG. 1.

DETAILED DESCRIPTION OF THE INVENTION

Figure 1:
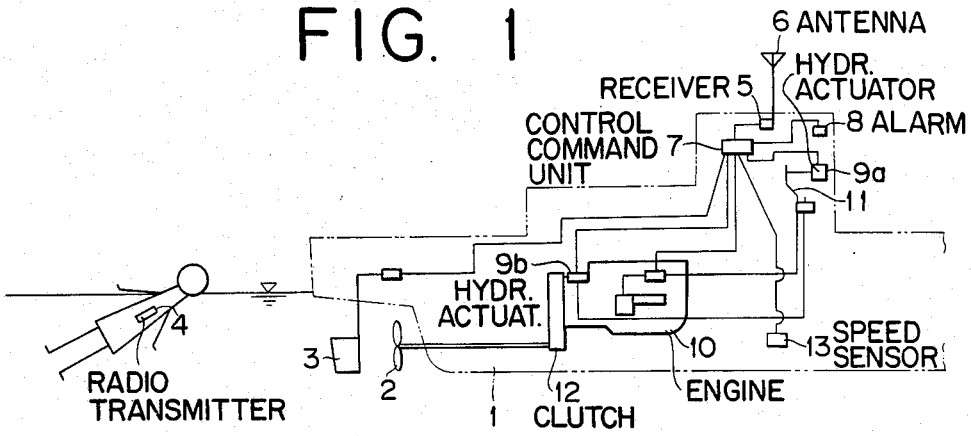

The present invention will now be described by way of example only with reference to the accompanying drawings.

In the drawings, reference numeral 1 denotes a ship, in particular a small-sized ship in which the sole crew member is on board and which is provided, at its rear portion, with a propeller 2 adapted to be driven by an engine 10 to propel the ship, and a rudder 3. Reference numeral 4 indicates a small-sized radio transmitter adapted to be attached to the crew member's body and to transmit a signal at a predetermined frequency at all times by turning a switch (not shown) on when the sole crew member is on board the ship. Further, although the sole crew member having a radio transmitter 4 attached to his body is shown, a plurality of radio transmitters 4 may be provided so that a plurality of crew member's may use each one of them. In such a case, the radio transmitters 4 have their respective frequencies different from one another.

Reference numeral 5 denotes a receiver mounted on the ship and adapted to receive all the frequencies of the signals transmitted by the above-mentioned radio transmitter 4, such a signal being received at an antenna 6.

A control command unit 7 is connected to the output side of the above-mentioned receiver 5 so that, when one or plurality of signal(s) with a frequency or their respective frequencies set previously at the receiver 5 is or are stopped or when such signal(s) is or are attenuated suddenly, an alarm 8 connected with the output side of the control command unit 7 is actuated to give an alarm, and at the same time, a hydraulic actuator **9*a* is actuated to operate an engine control lever 11 to a low speed, and another actuator 9*b* is also actuated to disengage a clutch 12 adapted to connect the engine 10 and a shaft of the propeller 2** to thereby stop the ship.

According to a further embodiment of the present invention, the above-mentioned actuator **9*b* is adapted to operate the clutch 12 interposed between the engine 10 and the propeller 2 to thereby rotate the propeller 2 reversely. When the clutch 12 is actuated in the reverse direction, the radio receiver 5 transmits an output signal so as to enable the ship 1** to move astern at a low speed.

Figure 2:
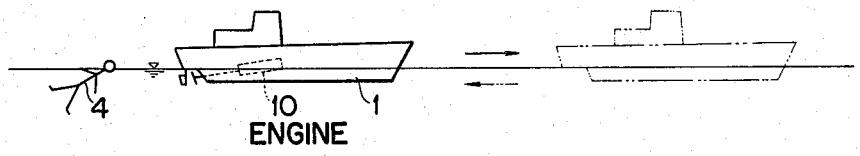

The running speed of the ship when the crew member falls overboard and the time which passes from the time when the crew member has fallen overboard to the time when the ship stops are computed by means of a control command unit in accordance with the speed signal which is input by a ship's speed sensor 13. The arrangement is made such that the result of computation thus obtained controls the time for backward running of the ship 1. By such an arrangement, the ship 1 is stopped when the ship arrives at a position near the crew member who fell overboard (refer to FIG. 2), and further for the sake of safety, the clutch 12 is disengaged by the action of the actuator 9b so as to stop running of the propeller 2.

Figure 3:
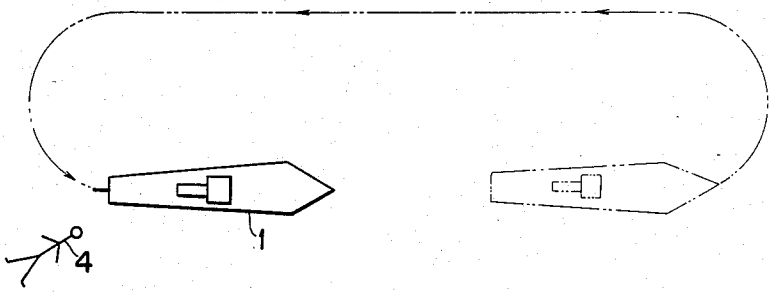

Although, in the aforementioned embodiment of the present invention the arrangement is made such that when the crew member fell overboard the ship 1 is moved astern to a position near him, as an alternative shown in FIG. 3, the rudder 3 may be controlled to allow the ship 1 to turn at a low speed and stop in the vicinity of the crew member who fell overboard.

Further, although in the aforementioned embodiment the clutch 12 is cut off or disengaged to stop running of the ship 1, the fuel supply system for the engine 10 may be cut off to stop the engine 10 itself.

Still further, it is possible to make arrangement such that the radio transmitter 4 can transmit not only the signal to stop the ship 1 when the crew member fell overboard, but also a rescue signal. Furthermore, a radio navigating function may be incorporated so as to permit the ship to be controlled or manoeuvred from a position remote from the operator's seat. Moreover, if a device for warning the consumption state of the battery is built in the radio transmitter 4, then enhanced safety can be secured.

It is to be understood that the foregoing description is merely illustrative of the preferred embodiments of the present invention and that the present invention is not to be limited thereto, but is to be determined by the scope of the appended claims.

What I claim is:

1. A system for automatically controlling navigation of a ship, comprising a radio transmitter attached to the body of a sole crew member, a radio receiver installed on board the ship so as to receive a signal transmitted by said radio transmitter, and a control command unit connected with the output side of said radio receiver so as to control the prime mover of the ship to thereby stop the prime mover of the ship if the crew member falls overboard, wherein said radio transmitter transmits a radio signal while the crew member is on board the ship and stops or attenuates the signal if the crew member falls overboard, said radio receiver transmits an output signal to said control command unit when the generation of the signal by said transmitter is stopped or when the signal is attenuated, and wherein said control command unit is provided with means to receive an output signal from said radio receiver, if the crew member falls overboard, to thereby decelerate the prime mover of the ship, compute the time which passes from the time when the crew member fell overboard to the time when the prime mover of the ship has been decelerated and control the power line and the steering system of the ship in accordance with the computed time so that the ship moves ahead or astern or turns at a low speed to a position near the crew member and then stops.

2. The system claimed in claim 1 wherein said control command unit is arranged, if the crew member falls overboard, to sound an alarm, drive a first hydraulic actuator to operate an engine control lever to a low speed position, and also drive a second hydraulic actuator to cut off or disengage a clutch interposed between the engine and the propeller.

3. The system claimed in claim 1, wherein said radio transmitter transmits a rescue signal when the crew member falls overboard.

4. The system claimed in claim 1, wherein said radio transmitter incorporates a radio navigating function for the ship.

* * * * *